US005201006A

United States Patent [19]

Weinrich

[11] Patent Number: 5,201,006

[45] Date of Patent: Apr. 6, 1993

[54] HEARING AID WITH FEEDBACK COMPENSATION

[75] Inventor: Soren Weinrich, Espergaerde, Denmark

[73] Assignee: Oticon A/S, Denmark

[21] Appl. No.: 563,201

[22] Filed: Aug. 6, 1990

[30] Foreign Application Priority Data

Aug. 22, 1989 [DK] Denmark ..... 4128/89

[51] Int. Cl.[5] ..... H04R 25/00

[52] U.S. Cl. ..... 381/68; 381/68.2; 381/93

[58] Field of Search ..... 381/68, 68.6, 69, 150, 381/153, 154, 120, 121, 68.2, 68.4, 93

[56] References Cited

U.S. PATENT DOCUMENTS

| | | | |
|---|---|---|---|
| 3,944,944 | 3/1976 | Ellenbecker | 381/120 |
| 4,455,675 | 6/1984 | Bose et al. | 381/71 |
| 4,456,795 | 6/1984 | Saito | 381/68.2 |
| 4,485,272 | 11/1984 | Duong et al. | 381/93 |
| 4,649,565 | 3/1987 | Kaizer et al. | 381/120 |
| 5,003,606 | 3/1991 | Bordewijk | 381/68 |
| 5,033,090 | 7/1991 | Weinrich | 381/68.4 |

*Primary Examiner*—Jin F. Ng
*Assistant Examiner*—Huyen D. Le
*Attorney, Agent, or Firm*—Larson and Taylor

[57] ABSTRACT

In a hearing aid with feedback compensation by virtue of at least one secondary microphone feeding into a delay unit and an attenuator feeding into one input of a difference amplifier, the other input with opposite polarity of which is connected to the output of the primary microphone receiving the ambient sound to be amplified and fed into the hearing-aid receiver and output duct, at least two secondary signal paths are provided. Each path comprises a secondary microphone with its associated delay unit and attenuator. An operational control unit may select the strongest signal to be used for feedback compensation. This makes it possible to achieve feedback compensation in various situations, such as may arise e.g. with an "in-the-ear" hearing aid when the user is chewing or yawning, creating various possible paths from the output duct past the housing of hearing aid to the primary microphone.

13 Claims, 4 Drawing Sheets

HEARING AID WITH FEEDBACK COMPENSATION

TECHNICAL FIELD

The present invention relates to a hearing aid with feedback compensation to prevent "howling" or similar oscillatory phenomena, said hearing aid being of the kind set forth in the preamble of claim 1.

BACKGROUND ART

A hearing aid of this kind is described in DK patent application No. 1479/88, filed on Mar. 18, 1988, and in the corresponding U.S. application Ser. No. 322,387, filed on Mar. 13, 1989.

The hearing aid described as an exemplary embodiment in the applications referred to above is a so-called in-the-ear hearing aid, that comprises a vent canal communicating the part of the ear's external meatus situated internally of the hearing aid capsule with the ambient air. In such a hearing aid, the predominant sound-transmission path from the transducer to the primary microphone receiving the ambient sound to be amplified will normally comprise the vent canal, all other paths, such as more or less temporary gaps between the hearing-aid capsule and the wall of the meatus having a considerably greater attenuation than said path comprising the vent canal and hence also having a correspondingly smaller ability to produce unwanted feedback.

In hearing aids without such a vent canal, the predominance of one single sound-transmission path may be less marked; in fact, there may exist a number of possible paths, in which the predominance, i.e. the minimum attenuation, shifts from one to the other depending on the actual physical relations in the external meatus, being influenced by the user's jaw movements, such as in yawning, chewing or speaking and other conditions, such as the orientation in space of the user's head.

From the above it will be understood that with hearing aids thus having several possible predominant sound-transmission paths between the transducer and the primary microphone, the use of a single secondary signal path effecting feedback compensation will be insufficient to prevent feedback from occurring, when either of said several possible paths is made active, such as by the user yawning.

DISCLOSURE OF THE INVENTION

It is the object of the present invention to provide a hearing aid of the kind initially referred to, in which the risk of unwanted feedback causing "howling" or the like is eliminated or at least considerably reduced, and this object is achieved in a hearing aid additionally exhibiting the feature set forth in the characterizing clause of claim 1. This makes it possible to provide feedback compensation for a number of possible more or less temporary sound-transmission paths capable of producing unwanted feedback, i.e. feedback causing "howling" or the like.

Advantageous embodiments of the hearing aid according to the present invention, the effects of which are explained in the following detailed portion of the present specification, are set forth in claims 2–11.

BRIEF DESCRIPTION OF THE DRAWINGS

The present invention will now be explained in a more detailed manner with reference to the partly highly diagrammatic and simplified drawings, in which.

DESCRIPTION OF THE PREFERRED EMBODIMENTS

Figure 1:
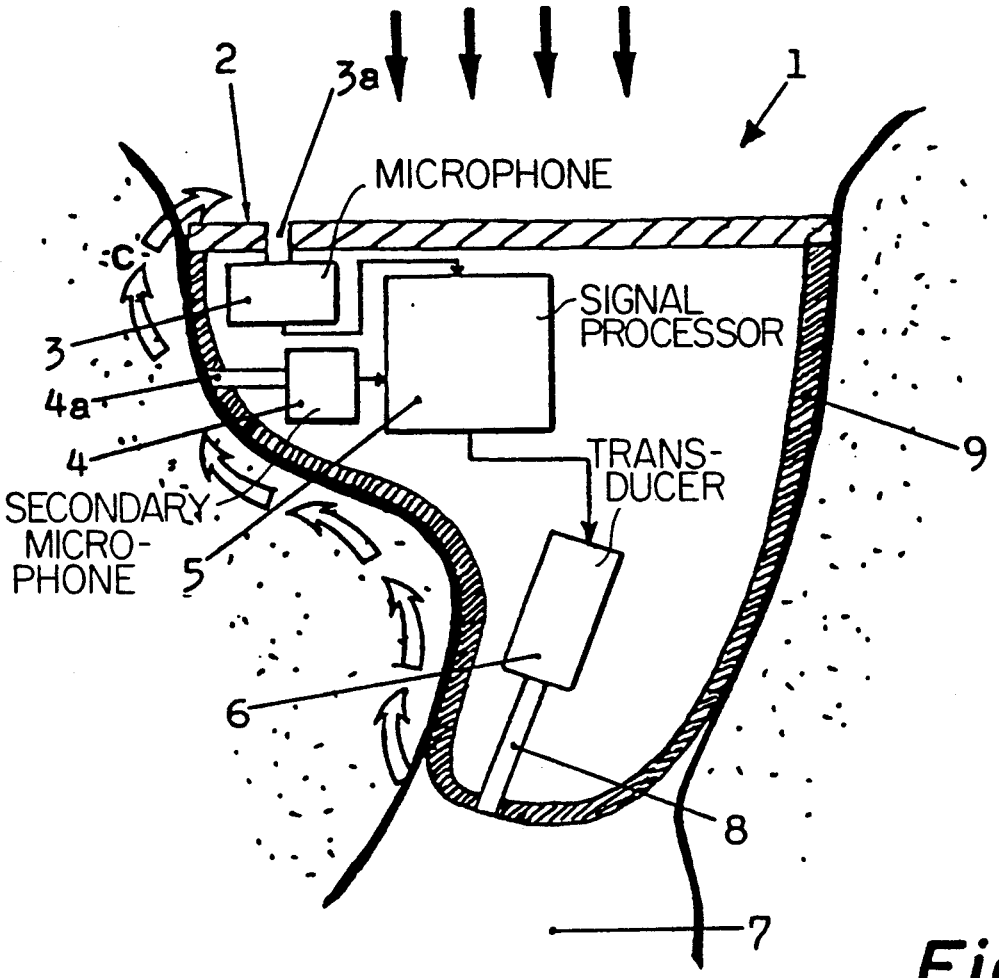
FIG. 1 shows an example of a hearing aid employing feedback-compensating principles described in the above patent applications.
Figure 2:
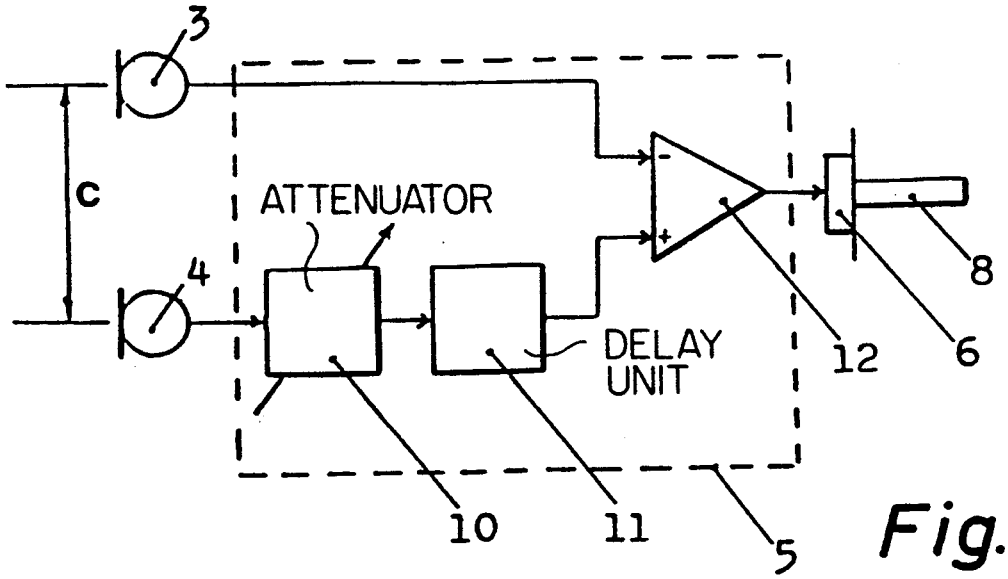
FIG. 2 is a block diagram of the electrical circuit in the hearing aid of FIG. 1.

FIGS. 1 and 2 illustrate the basic concept of feedback compensation as utilized in the hearing aid described in the above patent applications.

FIG. 1 shows a hearing aid 1 of the type adapted to be worn in the user's external auditory meatus, indicated by the surrounding tissue. The principles of the present invention may, however, be applied with equal effect to other types of hearing aids, in which there is a risk of acoustic feedback causing "howling" from the transducer supplying sound vibrations to the user's auditory sense organs to the microphone receiving the ambient sound to be amplified. For this reason, it will be obvious that the scope of the present invention, as defined in the claims, is not limited to the type of hearing aid described here in order to explain and exemplify the present invention, this hearing aid commonly being called an "in-the-ear" hearing aid or for short an ITE hearing aid. Thus, to mention but one example, the present invention may also be applied to "behind-the-ear" hearing aids, for short BTE hearing aids.

The hearing aid 1 comprises a housing or capsule consisting mainly of an outer panel 2 and a shaped portion 9. This housing or capsule contains

- a primary microphone 3 adapted to receive ambient sound, symbolized by the black arrows, through a primary duct 3*a*, said primary microphone's output signal being delivered as a primary input signal to
- an electronic signal processor 5, the output signal of which is delivered to
- an electro-acoustic transducer or receiver 6, connected to the part 7 of the user's external auditory meatus proximal of the hearing aid through an output duct 8, and
- a secondary or feedback-suppressing microphone 4, adapted to receive sound through a secondary duct 4*a*, said sound mainly originating from said proximal part 7 and being transmitted through the surrounding tissue as indicated by the white arrows or through passages (not shown) between the shaped portion 9 and the wall of the auditory meatus, the output signal of said secondary microphone being fed to a secondary input on said electronic signal processor 5.

As may be seen from FIG. 2, the output signal from the primary microphone 3 is supplied to the negative input of a difference amplifier 12, the output of which is connected to the receiver 6. The output signal from the secondary microphone 4 is fed to an attenuator 10 and a delay unit 11 before arriving in an attenuated and delayed condition at the positive input on said difference amplifier 12. Both the attenuator 10 and the delay unit 11 are adjustable, and by suitably adjusting these units, that part of the output signal from the primary microphone 3 due to this microphone receiving sound transmitted along the paths indicated from the output duct 8 may be counteracted by a signal of the same magnitude. This adjustment mainly entails adjusting the attenuation in the attenuator 10 and the delay in the delay unit 11 to correspond to the attenuation and delay suffered by the sound from the output duct 8 when passing through the distance c from the secondary duct 4*a* to the primary duct 3*a*, if necessary taking account of the length of the ducts.

If the secondary sound transmission path symbolized by the white arrows and extending past the secondary duct 4*a* always is the only one or the predominant secondary sound path, through which sound may reach the primary microphone 1 from the output duct 8, then the arrangement shown in FIGS. 1 and 2 will function satisfactorily to suppress acoustic feedback of a magnitude capable of producing "howling". It may well happen, however, that the user, particularly by moving his/her jaw in such activities as chewing, yawning or merely speaking, may change the shape of the external auditory meatus to such an extent, that other secondary paths arise in various positions around the housing or capsule 2, 9, even in the form of more or less open channels or ducts, and these other secondary paths may well have lower values of attenuation than the path shown in FIG. 1.

It will be obvious that under such circumstances, unwanted feedback may easily arise through the other secondary paths, and it will hence be necessary to make arrangements for suppressing also secondary signals transmitted by such paths. An example of such an arrangement according to the present invention will now be described with reference to FIG. 3.

Figure 3:
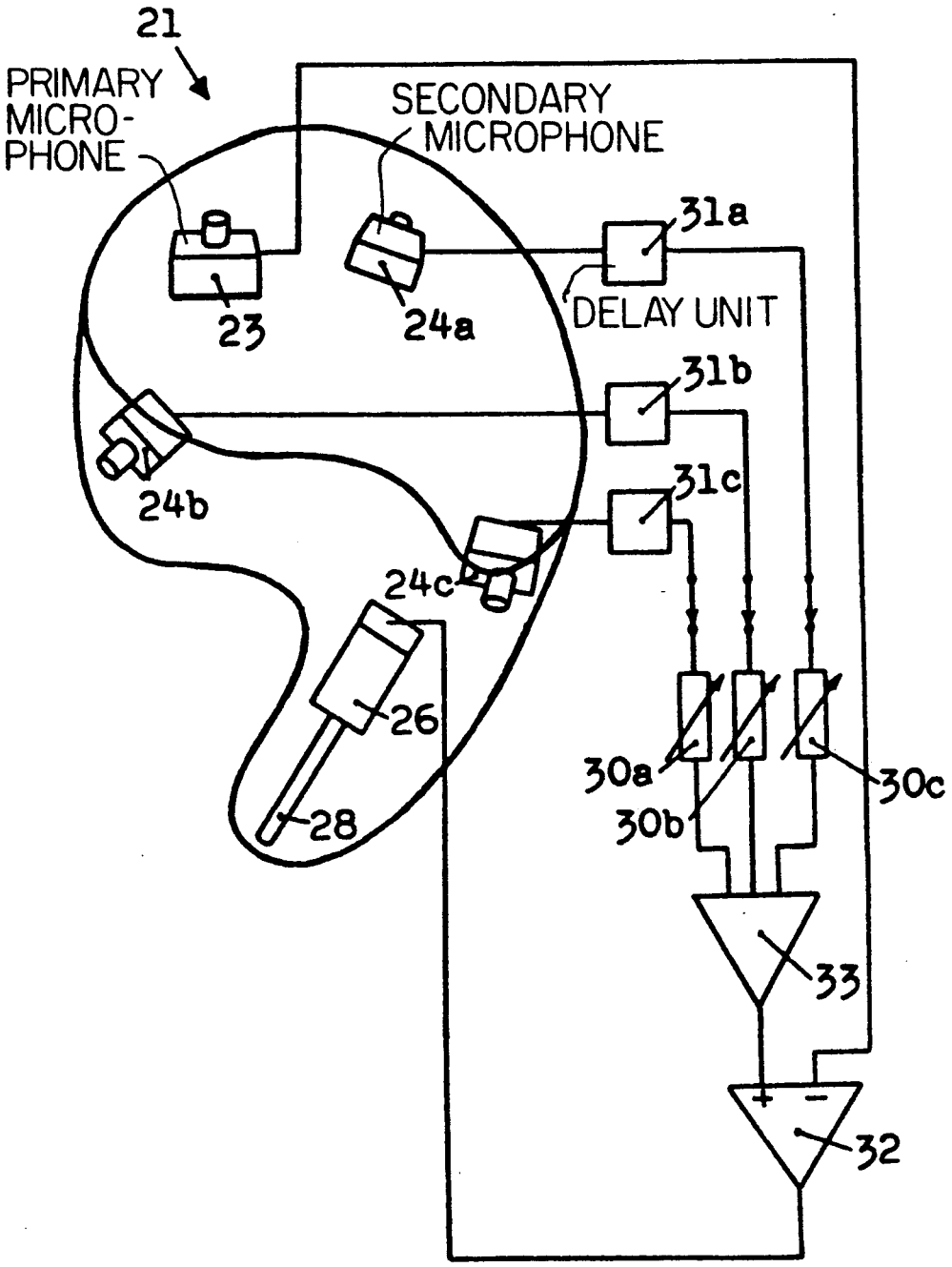
FIG. 3 shows an exemplary embodiment of a hearing aid employing the principles of the present invention.
Figure 4:
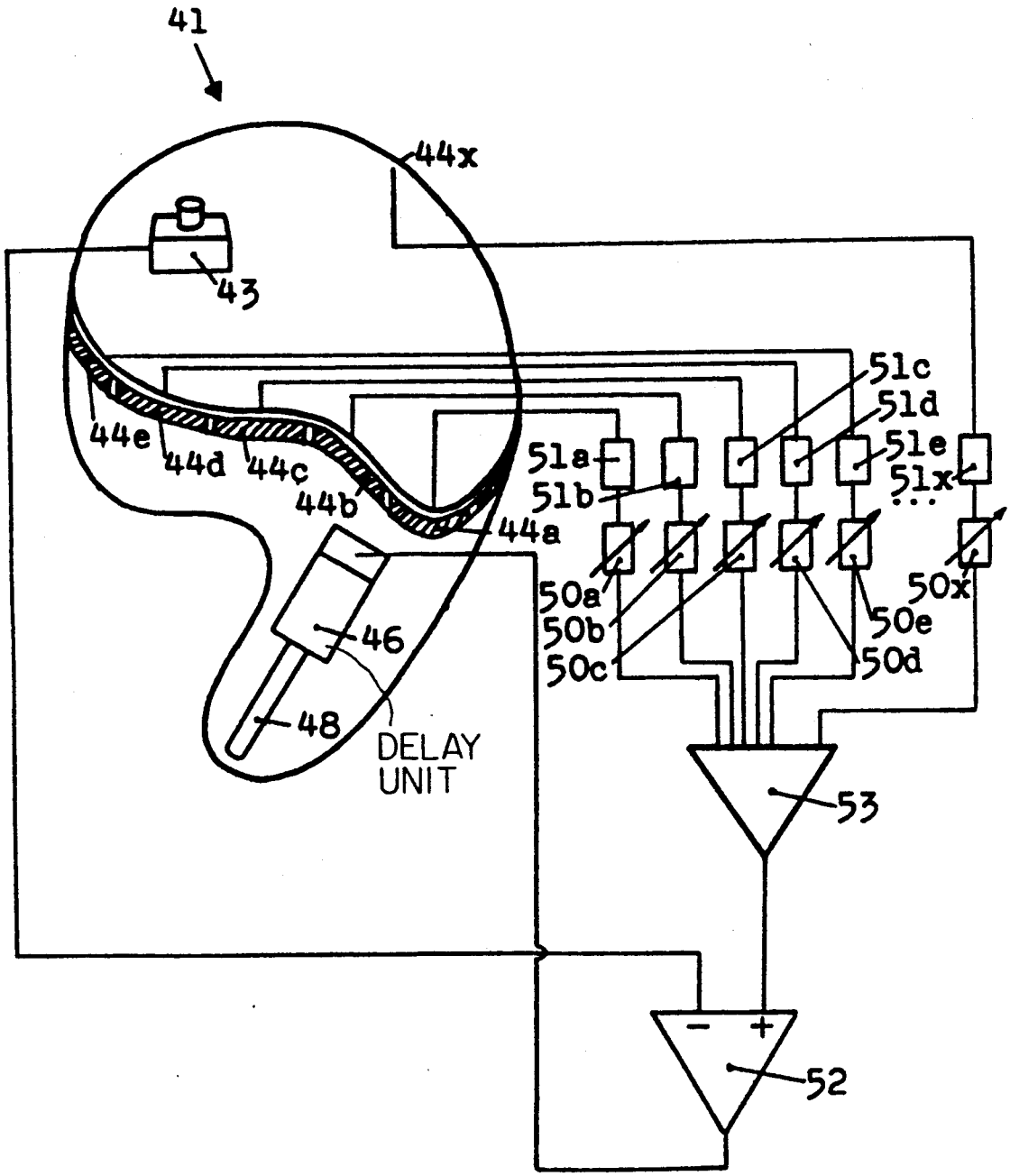
FIG. 4 shows another exemplary embodiment of a hearing aid employing the principles of the present invention.

For the sake of good order it should be mentioned that FIGS. 3 and 4 show some of the components outside of the hearing-aid housing, whereas they in actual practice will be found inside the housing, together with the necessary batteries, switches etc.

The hearing aid 21 can be imagined as physically resembling the hearing aid 1 of FIG. 1. It also comprises a primary microphone 23 feeding into the negative input of a difference amplifier 32, but instead of having one single secondary microphone as in the embodiment of FIG. 1, it has three secondary microphones 24*a*, 24*b* and 24*c*, each feeding into a delay unit 31*a*, 31*b* and 31*c*, respectively, and an attenuator 30*a*, 30*b* and 30*c*, respectively, the outputs of the attenuators being individually connected to three separate inputs of an operational control unit 33, the output of which is connected to the positive input of the difference amplifier 32. The latter feeds the receiver 26 with its output duct 28 in the same manner as described above with reference to FIGS. 1 and 2.

The operational control unit 33 contains electronic circuitry and/or so-called logical elements, arranged in such a manner that the output of that one of the attenuators 30*a*–30*c* at any moment producing the strongest signal is connected to the positive input of the difference amplifier 32. This means, of course, that that one of the three possible feedback paths served by the three secondary microphones 24*a*–24*c* constituting the predominant feedback path is used to produce the counter-signal at the positive input of the difference amplifier 32. In this manner, whichever of the three possible—or at least contemplated—feedback paths carrying the greater risk of producing unwanted feedback capable of making the hearing aid "howl" will be brought into operation by the operational control unit 33.

A person skilled in the art of electronics and logical circuitry will know how to construct an operational control unit having the functions of the unit 33 described above, for which reason further detailed description is deemed unnecessary. It may, however, be mentioned that such a control unit should at least comprise means or functions capable of measuring the output signals from all attenuators 30*a*–30*c* separately, comparing such measurements, and connecting the output of that one of said attenuators carrying the strongest signal to the positive input of the difference amplifier 32.

The exemplary embodiment shown in FIG. 3 comprises three secondary microphones 24*a*–24*c* in the form of "normal" acoustic-electrical transducers, possibly comprising a small housing containing a diaphraghm, a sensor, such as a moving-coil arrangement, an electret element or a piezo-electric crystal. It will be obvious that the use of a great number of such secondary microphones in a small hearing aid especially one of the "in-the-ear" type, may cause problems due to lack of space or difficulties in making the microphones sufficiently small. FIG. 4 shows an example of an approach to solving this problem.

The hearing aid 41 shown in FIG. 4 comprises a primary microphone 43 feeding into the negative input of a difference amplifier 52, as well as a plurality of secondary microphones 44*a*, 44*b*, 44*c* . . . 44*x*, each feeding into a delay unit 51*a*, 51*b*, 51*c* ..... 51*x* and an attenuator 50*a*, 50*b*, 50*c* . . . 50*x*, respectively, the outputs of the attenuators being individually connected to a corresponding plurality of separate inputs of an operational control unit 53, the output of which is connected to the positive input of the difference amplifier 52. The latter feeds the receiver 46 with its output duct 48 in the same manner as in the embodiment of FIG. 3.

The operational control unit 53 functions in the same manner as the operational control unit 33 in the embodiment of FIG. 3, for which reason further description or explanation should be unnecessary. The important difference between the embodiment of FIG. 4 and that of FIG. 3 is that in the latter, the secondary microphones 24*a*–24*c* are "discrete components", i.e. separate components fitted into the hearing aid after being manufactured singly, whereas in the embodiment of FIG. 4, the secondary microphones 44*a*, 44*b* . . . 44*x* are elements integral with, more or less embedded in or adhered to the hearing-aid housing. Any type of element capable of producing an output signal (voltage) as a result of being influenced by sound waves in the surrounding medium may be used. Such elements could constitute piezo-electric elements or so-called electrets, i.e. permanently electrically stressed dielectric elements, or any other type of element suitable for the purpose. It will be obvious that the use of substantially "two-dimensional" elements of the type referred to as the secondary microphones 44*a*, 44*b* . . . 44*x* will result in a considerable saving of space, thus making it possible to equip the hearing aid with secondary microphones in a number sufficiently great to take into account practically all possible acoustic feedback paths, which may arise during the user's various activities as described above.

Figure 5:
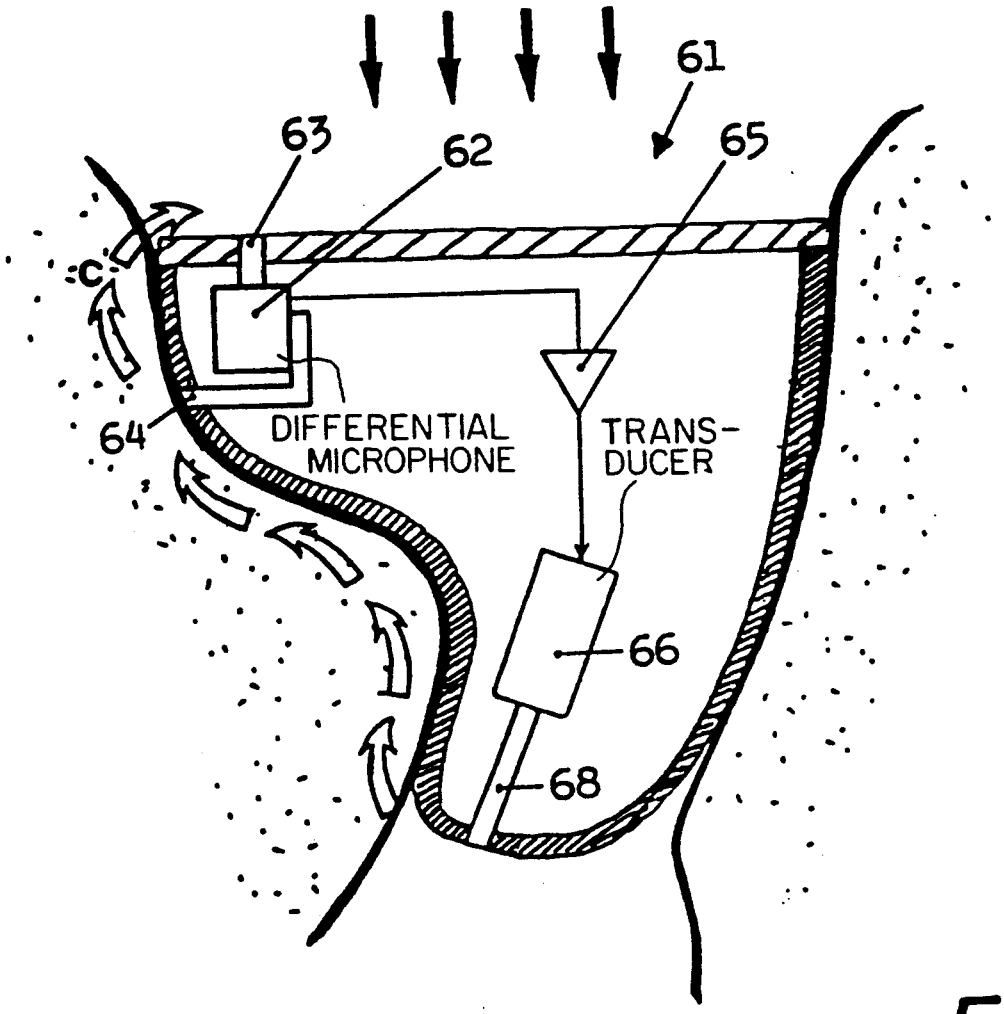
FIG. 5 shows an example of how the feedback compensation can be achieved by acoustical means.

FIG. 5 shows a hearing aid 61, in which the feedback compensation means are purely acoustical in nature. This hearing aid comprises a differential microphone 62, the front chamber of which is adapted to receive ambient sound (symbolized by the black arrows) through a primary duct 63, the rear chamber being adapted to receive sound from the receiver 66 and output duct 68 through a secondary duct 64. The output of the differential microphone (or sound-gradient microphone) 62 is connected to the input of an amplifier 65 feeding the receiver 66 producing sound waves in the output duct 68.

In order that the sound transmitted from the output duct 68 (as symbolized by the white arrows) to the primary duct 63 may be cancelled, the effective length of the secondary duct 64 should equal the effective length of the sound-transmission path from the entrance of the secondary duct 64 past the hearing-aid housing and through the primary duct 63 into the front chamber of the differential microphone 62. For this purpose it may be necessary to introduce bends or convolutions in the secondary duct 64 to make it sufficiently long. Also, the strength of the secondary signal entering the rear chamber of the differential microphone 62 should be adjusted, such as by an acoustical attenuator of any suitable type. An example of how this may be achieved is described in the above-mentioned patent applications.

For simplicity and ease of understanding, the embodiment of FIG. 5 is shown as having only one set of feedback-compensating means, consisting of the secondary duct 64 and its associated attenuator (not shown). In order to carry out the principles of the present invention, there should be at least two such sets of feedback-compensating means, each having a secondary duct having its entrance placed in a position different from that of the others, and having its length and attenuation adjusted for optimum compensation in the case that the feedback path it serves is made active, such a by the user chewing or yawning.

It also lies within the scope of the present invention to combine features from the various embodiments shown, e.g. by using one or two sets of acoustic feedback-compensating means as described with reference to FIG. 5, combined with a number of those partly electrical sets of feedback-compensating means shown in FIG. 3 or 4.

I claim:

1. A hearing aid of the type having
   a1) a primary microphone for receiving ambient sound and for producing electrical signals corresponding thereto on a primary signal path,
   a2) an amplifier for amplifying the electrical signals on said primary signal path to produce amplified signals,
   a3) an electro-acoustic transducer for converting said amplified signals into acoustical signals and for directing the acoustic signals toward the user's eardrum or other sound-sensitive organ, and
   b) at least two secondary signal paths each leading from a location in a predominant sound-transmission path between said transducer and said amplifier, the transmission times ($\Delta t$) along each of said secondary signal paths being substantially equal to the transmission time along said predominant sound-transmission path from each said location to said primary microphone, the output signals from each of said secondary signal paths being delivered to the input of said amplifier substantially in opposite phase and equal amplitude to the signals received by said amplifier from said primary microphone and caused by sound to be propagated along said predominant path.

2. A hearing aid according to claim 1, further comprising an operational control unit adapted to automatically make and keep said amplifier operative.

3. A hearing aid according to claim 2, characterized in that said operational control unit comprises
   a) means for measuring the outputs from the secondary signal paths separately,
   b) means for comparing the output measurements, and
   c) means to make and keep said amplifier operative.

4. A hearing aid according to claim 2, characterized in that said operational control unit comprises
   a) means for measuring the outputs from the secondary signal paths separately,
   b) means for comparing said output measurements, and
   c) and means for conducting the output to said amplifier of solely that one of the secondary signal paths producing the strongest output.

5. A hearing aid according to claim 1, characterized in that each secondary signal path comprises
   a) a secondary microphone placed at or near said location,
   b) an electrical signal delay unit, the input of which is connected to the output of said secondary microphone, and
   c) an attenuator, the input of which is connected to the output of said electrical signal delay unit, and the output of which is connected to said amplifier in a sense to counteract to the signal from the primary microphone caused by sound propagated along said predominant path.

6. A hearing aid according to claim 5, characterized in that said amplifier is a difference amplifier with two inputs, one of which is connected to the output of the primary microphone and the other of which is connected or connectable to the outputs of said attenuator.

7. A hearing aid according to claim 1 and comprising a housing for at least a part of the hearing aid, said housing being adapted to be placed in the external meatus of the human ear and having said electro-acoustic transducer placed with a sound-producing duct or cavity directed inwardly in said external meatus, characterized in that said secondary paths include secondary microphones situated and adapted to receive sound from various places on the external wall of said housing likely to be acoustically relatively well connected to the part of said external meatus inwardly of said housing, when said external meatus takes various shapes depending on whether the user is chewing yawning or speaking or being silent.

8. A hearing aid according to claim 7, characterized in that at least one of the secondary microphones is constituted by an acoustic-electrical transducer attached to or embedded in the wall of said housing.

9. A hearing aid according to claim 1, characterized in that each secondary signal path comprises a duct leading from said location in said predominant sound-transmission path to an acoustical input in said microphone adapted to cause the generation of signals opposite in phase to the signals generated in response to said ambient sound.

10. A hearing aid according to claim 9, characterized in a) that said microphone is of the type having a front cavity and a rear cavity, sound received in the two cavities producing signals of opposite phase in the output of the microphone, and b) that one of said cavities is acoustically connected (63) to the surrounding atmosphere, while the other cavity is acoustically connected to the output ends of said ducts.

11. A hearing aid according to claim 9, characterized in that the output end of each duct is provided with an acoustical impedance-matching element placed in an aperture in the wall of said tube.

12. A hearing aid according to claim 9, characterized in that each duct is provided with an adjustable acoustical valve.

13. A hearing aid according to claim 1, further comprising an operational control unit adapted to conduct the output to said amplifier of solely that one of said secondary signal paths producing the strongest output.

* * * * *